US012760238B2

(12) United States Patent
Harhausen et al.

(10) Patent No.: US 12,760,238 B2
(45) Date of Patent: Oct. 13, 2026

(54) INCREASED ELECTRIC CONDUCTIVITY OF A LUBRICANT WITH AMPHIPHILIC AMINE AND AMPHIPHILIC ACID

(71) Applicant: BASF SE, Ludwigshafen am Rhein (DE)

(72) Inventors: Marcel Harhausen, Ludwigshafen am Rhein (DE); Andre Mueller, Ludwigshafen am Rhein (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 18/858,370

(22) PCT Filed: Apr. 11, 2023

(86) PCT No.: PCT/EP2023/059406
§ 371 (c)(1),
(2) Date: Oct. 21, 2024

(87) PCT Pub. No.: WO2023/202914
PCT Pub. Date: Oct. 26, 2023

(65) Prior Publication Data

US 2025/0277163 A1 Sep. 4, 2025

(30) Foreign Application Priority Data

Apr. 22, 2022 (EP) ..... 22169466

(51) Int. Cl.

| | |
|---|---|
| ***C10M 169/04*** | (2006.01) |
| ***C10M 101/02*** | (2006.01) |
| ***C10M 129/40*** | (2006.01) |
| ***C10M 129/42*** | (2006.01) |
| ***C10M 129/66*** | (2006.01) |
| ***C10M 133/16*** | (2006.01) |
| ***C10M 133/46*** | (2006.01) |
| ***C10M 141/06*** | (2006.01) |
| *C10N 30/00* | (2006.01) |
| *C10N 40/00* | (2006.01) |
| *C10N 40/08* | (2006.01) |

(52) U.S. Cl.

CPC ..... *C10M 169/04* (2013.01); *C10M 101/02* (2013.01); *C10M 129/40* (2013.01); *C10M 129/42* (2013.01); *C10M 129/66* (2013.01); *C10M 133/16* (2013.01); *C10M 133/46* (2013.01); *C10M 141/06* (2013.01); *C10M 2203/1006* (2013.01); *C10M 2207/126* (2013.01); *C10M 2207/127* (2013.01); *C10M 2207/24* (2013.01); *C10M 2215/08* (2013.01); *C10M 2215/224* (2013.01); *C10N 2030/28* (2020.05); *C10N 2040/08* (2013.01); *C10N 2040/135* (2020.05)

(58) Field of Classification Search

CPC ..... C10M 169/04; C10M 101/02; C10M 129/40; C10M 129/42; C10M 129/66; C10M 133/16; C10M 133/46; C10M 141/06; C10N 2040/135; C10N 2030/28; C10N 2040/08

See application file for complete search history.

(56) References Cited

U.S. PATENT DOCUMENTS

| | | | | |
|---|---|---|---|---|
| 4,968,443 | A | 11/1990 | Lambert et al. | |
| 5,578,557 | A | 11/1996 | Dougan et al. | |
| 2008/0234155 | A1 | 9/2008 | Wardlow et al. | |
| 2017/0362525 | A1 | 12/2017 | Foster et al. | |
| 2018/0057767 | A1* | 3/2018 | Rakestraw | C10M 141/06 |
| 2019/0177651 | A1 | 6/2019 | Loper et al. | |
| 2020/0347317 | A1* | 11/2020 | Yamamoto | C10M 171/04 |

FOREIGN PATENT DOCUMENTS

| | | | |
|---|---|---|---|
| EP | 0351769 | A2 | 1/1990 |
| EP | 1975223 | A1 | 10/2008 |
| EP | 2132284 | A2 | 12/2009 |
| WO | 2012/151084 | A1 | 11/2012 |

* cited by examiner

*Primary Examiner* — Vishal V Vasisth
(74) *Attorney, Agent, or Firm* — Faegre Drinker Biddle & Reath LLP

(57) ABSTRACT

The invention relates to a use of a blend comprising an amphiphilic amine, and an amphiphilic acid for increasing the electric conductivity of a lubricant based on a hydrocarbon oil. The invention further relates to a method for increasing the electric conductivity of a lubricant based on a hydrocarbon oil comprising the step of contacting the hydrocarbon oil with a blend comprising the amphiphilic amine, and the an amphiphilic acid; and to a lubricant based on a hydrocarbon oil comprising a blend comprising the amphiphilic amine which is a compound of formula (A1) and the amphiphilic acid which is selected from compounds (B1), (B3), (B4), (B5), fatty acids, or alkylbenzene sulfonic acids.

11 Claims, No Drawings

INCREASED ELECTRIC CONDUCTIVITY OF A LUBRICANT WITH AMPHIPHILIC AMINE AND AMPHIPHILIC ACID

CROSS-REFERENCE TO RELATED APPLICATIONS

This application is a National stage application (under 35 U.S.C. § 371) of PCT/EP2023/059406, filed Apr. 11, 2023, which claims benefit of European Application No. 22169466.4, filed Apr. 22, 2022, both of which are incorporated herein by reference in their entirety.

The invention relates to a use of a blend comprising an amphiphilic amine, and an amphiphilic acid for increasing the electric conductivity of a lubricant based on a hydrocarbon oil. The invention further relates to a method for increasing the electric conductivity of a lubricant based on a hydrocarbon oil comprising the step of contacting the hydrocarbon oil with a blend comprising the amphiphilic amine, and the an amphiphilic acid; and to a lubricant based on a hydrocarbon oil comprising a blend comprising the amphiphilic amine which is a compound of formula (A1) and the amphiphilic acid which is selected from compounds (B1), (B3), (B4), (B5), fatty acids, or alkylbenzene sulfonic acids. Combinations of preferred embodiments with other preferred embodiments are within the scope of the present invention.

Friction between two surfaces in close contact typically gives rise to electrostatic charge or static electricity. This may result in unwanted electrostatic discharge. Lubricants based on hydrocarbon base oil usually have a very low electric conductivity. Thus, this could result in the buildup of an unwanted electrostatic discharge and needs to be controlled by suitable lubricant additives which increase the electric conductivity of the lubricant. In addition, lubricants have to provide during their lifetime many additional requirements, such as wear protection, oxidation stability, deposit control, and corrosion inhibition. Object of the present invention was to solve these problems.

The object was achieved by a use of a blend comprising

A) an amphiphilic amine, and

B) an amphiphilic acid for increasing the electric conductivity of a lubricant based on a hydrocarbon oil.

The object was also solved by a method for increasing the electric conductivity of a lubricant based on a hydrocarbon oil comprising the step of contacting the hydrocarbon oil with a blend comprising A) an amphiphilic amine, and B) an amphiphilic acid.

The object was also solved by a lubricant based on a hydrocarbon oil comprising a blend comprising A) an amphiphilic amine which is a compound of formula (A1)

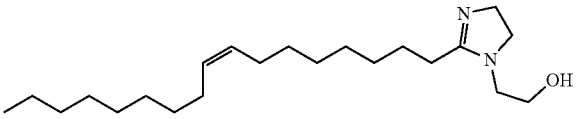

and

B) an amphiphilic acid which is selected from compounds (B1), (B3), (B4), (B5)

(B1)

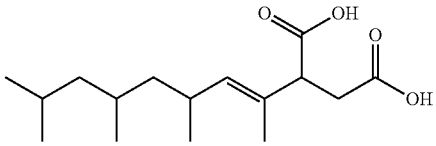

(B3)

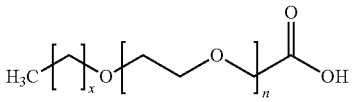

where x is from 11 to 13 and n from 2 to 15, and (B4)

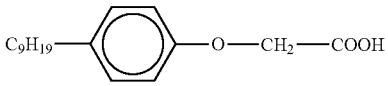

(B5)

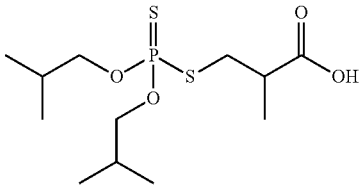

fatty acids, or alkylbenzene sulfonic acids.

The amphiphilic amine may comprise an unpolar group and a polar group, which contains an amine group.

The amphiphilic amine may comprise an amine group which contains a primary, secondary, tertiary or quarternary amine, preferably a primary, secondary, tertiary amine, in particular a tertiary amine. Preferably, the amphiphilic amine comprises an amine group which is selected from an imidazolin group.

The amphiphilic amine may comprise an unpolar group which contains a $C_{6-32}$ hydrocabon group, such as a linear, branched or cyclic alkyl or alkenyl. Preferably, the amphiphilic amine comprises an unpolar group which is selected from a $C_{6-32}$ alkyl or $C_{6-32}$ alkenyl, which may be linear or branched.

Preferably, the amphiphilic amine comprises an imidazolin group and a $C_{6-32}$ hydrocarbon group, such as a $C_{6-32}$ alkyl or $C_{6-32}$ alkenyl, which may be linear or branched.

In particular the amphiphilic amine is a compound of formula (A1)

(A1)

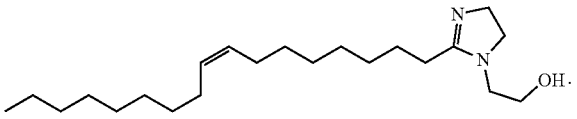

The amphiphilic amine has typically a solubility of at least 0.5, 1, 2, 3, 4, or 5 wt % in the hydrocarbon oil at 20° C.

The amphiphilic acid may comprise an unpolar group and a polar group, which contains an acid group, such as a carboxylic acid group (e.g. —C(O)OH), a sulfonic acid group (e.g. —$SO_3H$), or a phosphonic acid group (e.g.

—$P(O)(OH)_2$). Preferably, the amphiphilic acid comprises an unpolar group and a polar group, which contains an acid group selected from a carboxylic acid group, a sulfonic acid group, or a phosphonic acid group. Preferably, the amphiphilic acid comprises an unpolar group and a polar group, which contains an carboxylic acid group or a sulfonic acid group. The acid group may be present in the protonated or unprotonated form, e.g. as salt. Preferably, the amphiphilic acid comprises an unpolar group and a polar group, which contains an acid group.

The amphiphilic amine may comprise an unpolar group which contains a $C_{6-32}$ hydrocabon group (such as a linear, branched or cyclic alkyl, alkenyl, or alkylaryl) or at least two isobutyl groups. Preferably, the amphiphilic acid comprises an unpolar group which is selected from a $C_{6-32}$ alkyl, which may be linear or branched, a $C_{6-32}$ alkenyl, which may be linear or branched, a $C_{6-32}$ alkylaryl, which may be linear or branched, or at least two isobutyl. In another preferred form the amphiphilic acid comprises an unpolar group which is selected from a $C_{6-32}$ alkyl, which may be linear or branched, a $C_{6-32}$ alkenyl, which may be linear or branched, or a $C_{6-32}$ alkylaryl, which may be linear or branched.

The amphiphilic acid may comprise a carboxylic acid group and a $C_{6-32}$ (preferably $C_{8-18}$) hydrocarbon group or at least two isobutyl groups. In particular the amphiphilic acid is selected from the compounds (B1), (B2), (B3), (B4), and (B5)

(B1)

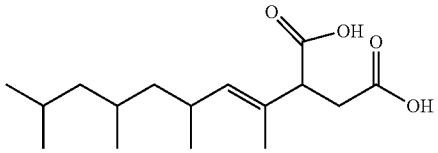

(B2)

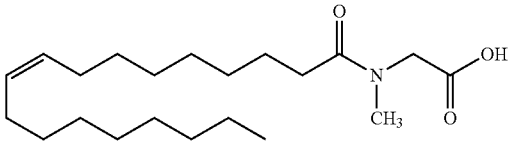

(B3)

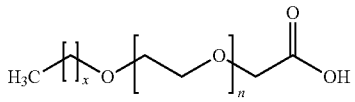

where x is from 11 to 13 and n from 2 to 15, (B4)

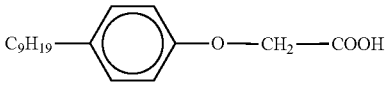

(B5)

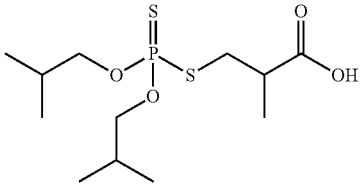

In compound (B3) x is usually from 11 to 13, and n from 2 to 15 (preferably n is from 3 to 11). In another particular form the amphiphilic acid is selected from the compounds (B1), (B2), (B3), and (B4).

Further examples of amphiphilic acids in addition to the compounds (B1), (B2), (B3), (B4) and (B5) are fatty acids, which can be saturated, unsaturated, hydroxy functionalized, or combinations thereof. Examples of saturated fatty acids are caprylic acid, capric acid, lauric acid, myristic acid, palmitic acid, stearic acid, arachidic acid, behenic acid, lignoceric acid and cerotic acid. Examples of unsaturated fatty acids are myristoleic acid, palmitoleic acid, oleic acid, linoleic acid, arachidonic acid, and erucic acid. Examples of hydroxy functionalized fatty acids are ricinoleic acid.

The amphiphilic acid may comprise a sulfonic acid group and a $C_{6-32}$ (preferably $C_{8-18}$) hydrocarbon group (e.g. a $C_{6-32}$ (preferably $C_{8-18}$) alkylaryl, which may be linear or branched), such as alkylbenzene sulfonic acids.

Suitable alkylbenzene sulfonic acids are linear and branched $C_8$-$C_{24}$ (preferably $C_{10-18}$) alkylbenzene sulfonic acids, such as dodecylbenzene sulfonic acid.

Preferably the amphiphilic acid is selected from the compounds (B1), (B2), (B3), (B4), (B5), fatty acids, or alkylbenzene sulfonic acids.

The amphiphilic acid has typically a solubility of at least 0.5, 1, 2, 3, 4, or 5 wt % in the hydrocarbon oil at 20° C.

In a preferred form the amphiphilic amine is the compound of formula (A1) and the amphiphilic acid is the compound (B1). In another preferred form the amphiphilic amine is the compound of formula (A1) and the amphiphilic acid is the compound (B2). In another preferred form the amphiphilic amine is the compound of formula (A1) and the amphiphilic acid is the compound (B3). In another preferred form the amphiphilic amine is the compound of formula (A1) and the amphiphilic acid is the compound (B4). In another preferred form the amphiphilic amine is the compound of formula (A1) and the amphiphilic acid is the compound (B5). In another preferred form the amphiphilic amine is the compound of formula (A1) and the amphiphilic acid is a fatty acid. In another preferred form the amphiphilic amine is the compound of formula (A1) and the amphiphilic acid is a linear or branched $C_8$-$C_{24}$ alkylbenzene sulfonic acids, such as dodecylbenzene sulfonic acid.

Preferably, the amphiphilic acid comprises a carboxylic acid group and a $C_{6-32}$ (in particular $C_{8-18}$) hydrocarbon group or at least two isobutyl groups; or a sulfonic acid group and a $C_{6-32}$ (in particular $C_{8-18}$) hydrocarbon group.

The weight ratio of the amphiphilic amine (e.g. compound (A1)) and the amphiphilic acid (e.g. compound (B1), (B2), (B3), (B4), (B5)) can be from 10:1 to 1:10, 5:1 to 1:5, or 3:1 to 1:3, or 2.5:1 to 1:2.5.

In a preferred form the amphiphilic amine is the compound of formula (A1) and the amphiphilic acid is the compound (B1), and the weight ratio of the amphiphilic amine and the amphiphilic acid is from 5:1 to 1:5. In another preferred form the amphiphilic amine is the compound of formula (A1) and the amphiphilic acid is the compound (B2), and the weight ratio of the amphiphilic amine and the amphiphilic acid is from 5:1 to 1:5. In another preferred form the amphiphilic amine is the compound of formula (A1) and the amphiphilic acid is the compound (B3), and the weight ratio of the amphiphilic amine and the amphiphilic acid is from 5:1 to 1:5. In another preferred form the amphiphilic amine is the compound of formula (A1) and the amphiphilic acid is the compound (B4), and the weight ratio of the amphiphilic amine and the amphiphilic acid is from 5:1 to 1:5. In another preferred form the amphiphilic amine is the compound of formula (A1) and the amphiphilic acid is the compound (B5), and the weight ratio of the amphiphilic amine and the amphiphilic acid is from 5:1 to 1:5. In another preferred form the amphiphilic amine is the compound of formula (A1) and the amphiphilic acid is a fatty acid, and the weight ratio of the amphiphilic amine and the amphiphilic acid is from 5:1 to 1:5. In another preferred form the amphiphilic amine is the compound of formula (A1) and the amphiphilic acid is a linear or branched $C_8$-$C_{24}$ alkylbenzene sulfonic acids, such as dodecylbenzene sulfonic acid, and the weight ratio of the amphiphilic amine and the amphiphilic acid is from 5:1 to 1:5.

The lubricant may comprises at least 10, 50, 100 or 150 ppm of the blend. The lubricant may comprises up to 2000, 1000, 800, 600 or 450 ppm of the blend. The lubricant may comprise 10 to 1000 ppm, 50 to 600 ppm, or 100 to 500 ppm of the blend.

The lubricant may comprises at least 10, 40, 60 or 80 ppm of the amphiphilic amine. The lubricant may comprises up to 1500, 1000, 800, 500, or 300 ppm of the amphiphilic amine. The lubricant may comprise 20 to 1000 ppm, 30 to 500 ppm, or 40 to 300 ppm of the amphiphilic amine.

The lubricant may comprises at least 10, 40, 60 or 80 ppm of the amphiphilic acid. The lubricant may comprises up to 1500, 1000, 800, 500, or 300 ppm of the amphiphilic acid. The lubricant may comprise 20 to 1000 ppm, 30 to 500 ppm, or 40 to 300 ppm of the amphiphilic acid.

The lubricant may comprise 20 to 1000 ppm, 30 to 500 ppm, or 40 to 300 ppm of the amphiphilic amine, and 20 to 1000 ppm, 30 to 500 ppm, or 40 to 300 ppm of the amphiphilic acid. Preferably, the lubricant comprises 30 to 500 ppm of the amphiphilic amine, and 30 to 500 ppm of the amphiphilic acid. In another preferred form the lubricant comprises 20 to 1000 ppm of the amphiphilic amine, and 20 to 1000 ppm of the amphiphilic acid.

The blend can be prepared by adding the amphiphilic amine the and the amphiphilic acid separately or simultaneously to the lubricant. In one form an additive package which comprises the blend and lubricant additives is contacted with the lubricant. In another form the amphiphilic acid and an additive package which comprises the amphiphilic amine and lubricant additives is contacted with the lubricant. In another form the amphiphilic amine and an additive package which comprises the amphiphilic acid and lubricant additives is contacted with the lubricant. The blend may have any form, e.g. solid or liquid.

The lubricant usually refers to compositions which are capable of reducing friction between surfaces (preferably metal surfaces), such as surfaces of mechanical devices. A mechanical device may be a mechanism consisting of a device that works on mechanical principles. Suitable mechanical device are bearings, gears, joints and guidances. The mechanical device may be operated at temperatures in the range of −30 C to 80° C.

Lubricants are usually specifically formulated for virtually every type of machine and manufacturing process. The type and concentration of base oils and/or lubricant additives used for these lubricants may be selected based on the requirements of the machinery or process being lubricated, the quality required by the builders and the users of the machinery, and the government regulation. Typically, each lubricant has a unique set of performance requirements. In addition to proper lubrication of the machine or process, these requirements may include maintenance of the quality of the lubricant itself, as well as the effect of the lubricant's use and disposal on energy use, the quality of the environment, and on the health of the user.

Typical lubricants are automotive lubricants (e.g. gasoline engine oils, diesel engine oils, gas engine oils, gas turbine oils, automatic transmission fluids, gear oils) and industrial lubricants (e.g. industrial gear oils, pneumatic tool lubricating oil, high temperature oil, gas compressor oil, hydraulic fluids, metalworking fluids).

Examples for lubricants are axel lubrication, medium and heavy duty engine oils, industrial engine oils, marine engine oils, automotive engine oils, crankshaft oils, compressor oils, refrigerator oils, hydrocarbon compressor oils, very low-temperature lubricating oils and fats, high temperature lubricating oils and fats, wire rope lubricants, textile machine oils, refrigerator oils, aviation and aerospace lubricants, aviation turbine oils, transmission oils, gas turbine oils, spindle oils, spin oils, traction fluids, transmission oils, plastic transmission oils, passenger car transmission oils, truck transmission oils, industrial transmission oils, industrial gear oils, insulating oils, instrument oils, brake fluids, transmission liquids, shock absorber oils, heat distribution medium oils, transformer oils, fats, chain oils, minimum quantity lubricants for metalworking operations, oil to the warm and cold working, oil for water-based metalworking liquids, oil for neat oil metalworking fluids, oil for semi-synthetic metalworking fluids, oil for synthetic metalworking fluids, drilling detergents for the soil exploration, hydraulic oils, in biodegradable lubricants or lubricating greases or waxes, chain saw oils, release agents, molding fluids, gun, pistol and rifle lubricants or watch lubricants and food grade approved lubricants.

The lubricant has usually may have a kinematic viscosity at 40° C. of at least 10, 50, 100, 150, 200, 300, 400, 500, 600, 900, 1400, or 2000 $mm^2/s$. In another form the lubricant has usually may have a kinematic viscosity at 40° C. from 200 to 30 000 $mm^2/s$ (cSt), preferably from 500 to 10 000 $mm^2/s$, and in particular from 1000 to 5000 $mm^2/s$. The lubricant has usually may have a kinematic viscosity at 100° C. of at least 2, 3, 5, 10, 20, 30, 40, or 50 $mm^2/s$. In another form the lubricant may have a kinematic viscosity at 100° C. from 10 to 5000 $mm^2/s$ (cSt), preferably from 30 to 3000 $mm^2/s$, and in particular from 50 to 2000 $mm^2/s$. The lubricant may have a viscosity index of at least 50, 75, 100, 120, 140, 150, 160, 170, 180, 190 or 200.

The lubricant is usually a lubricating liquid, lubricating oil or lubricating grease.

The hydrocarbon oil may be selected from base oils which are mineral oils (Group I, II or III oils), polyalphaolefins (Group IV oils), polymerized and interpolymerized olefins, alkyl naphthalenes (Group V oils).

Preferably, the hydrocarbon oil is a base oil is selected from Group I, Group II, Group III, and Group IV base oils according to the definition of the API, or mixtures thereof.

Definitions for the base oils are the same as those found in the American Petroleum Institute (API):

a) Group I base oils contain less than 90 percent saturates (ASTM D 2007) and/or greater than 0.03 percent sulfur (ASTM D 2622) and have a viscosity index (ASTM D 2270) greater than or equal to 80 and less than 120.
b) Group II base oils contain greater than or equal to 90 percent saturates and less than or equal to 0.03 percent sulfur and have a viscosity index greater than or equal to 80 and less than 120.
c) Group III base oils contain greater than or equal to 90 percent saturates and less than or equal to 0.03 percent sulfur and have a viscosity index greater than or equal to 120.
d) Group IV base oils contain polyalphaolefins. Polyalphaolefins (PAO) include known PAO materials which typically comprise relatively low molecular weight hydrogenated polymers or oligomers of alphaolefins which include but are not limited to C2 to about C32 alphaolefins with the C8 to about C16 alphaolefins, such as 1-octene, 1-decene, 1-dodecene and the like being preferred. The preferred polyalphaolefins are poly-1-octene, poly-1-decene, and poly-1-dodecene.

e) Group V base oils contain any base oils not described by Groups I to IV.

The lubricant is based on a hydrocarbon oil. The lubricant may comprise at least 50, 60, 70, 80 or 90 wt % of the hydrocarbon oil. The lubricant may comprise up to 70, 80, 90, 95, 97, 99, 99.9 or 99.99 wt % of the hydrocarbon oil. The lubricant may comprise 50 to 99.9 wt %, or 70 to 99 wt % of the hydrocarbon oil.

The electric conductivity of the hydrocarbon oil is usually below 30, 20, 15, 10 or 5 pS/m.

The electric conductivity (e.g. of the hydrocarbon oil or of the lubricant) may be determined at 20° C. with an electric conductivity meter, which are commercially available, e.g. Model 1152 Digital Conductivity Meter from EMCEE Electronics Inc., USA.

The blend can be used for increasing the electric conductivity of the lubricant. The increasement is typically found when determining the electric conductivity of the lubricant before and after contacting the lubricant with the blend.

In another form the increasement is typically found when determining the electric conductivity of the lubricant containing the blend and the same lubricant without the blend. The lubricant without the blend has usually an electric conductivity below 30, 20, 15, 10 or 5 pS/m. The lubricant comprising the blend may have an electric conductivity of at least 30, 40, 50, 60, 80 or 100 pS/m.

Suitable lubricant additives may be selected from viscosity index improvers, polymeric thickeners, antioxidants, corrosion inhibitors, detergents, dispersants, anti-foam agents, dyes, wear protection additives, extreme pressure additives (EP additives), anti-wear additives (AW additives), friction modifiers, metal deactivators, pour point depressants.

The invention also related to a method for increasing the electric conductivity of the lubricant based on the hydrocarbon oil comprising the step of contacting the hydrocarbon oil with the blend comprising A) the amphiphilic amine, and B) the amphiphilic acid.

The hydrocarbon oil can be contacted with the blend, or it can be contacted separately with the amphiphilic amine and the amphiphilic acid. In one form an additive package which comprises the blend and lubricant additives is contacted with the hydrocarbon oil. In another form the amphiphilic acid and an additive package which comprises the amphiphilic amine and lubricant additives is contacted with the hydrocarbon oil. In another form the amphiphilic amine and an additive package which comprises the amphiphilic acid and lubricant additives is contacted with the hydrocarbon oil.

The invention also relates to the lubricant based on the hydrocarbon oil comprising a blend comprising A) the amphiphilic amine which is a compound of formula (A1)

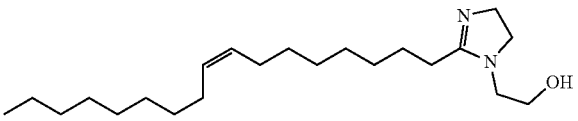

and

B) an amphiphilic acid which is selected from compounds (B1), (B3), (B4), (B5)

(B1)

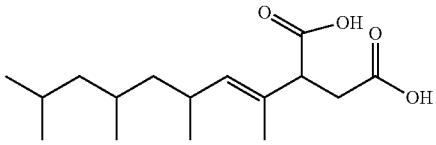

(B3)

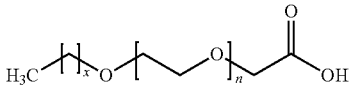

where x is from 11 to 13 and n from 2 to 15, and (B4)

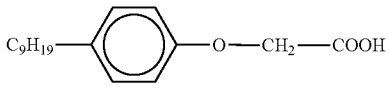

(B5)

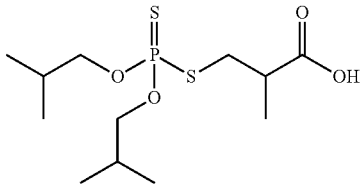

fatty acids, or alkylbenzene sulfonic acids.

Preferably, the amphiphilic acid is selected from compounds (B1), (B3), (B4), (B5), fatty acids, or alkylbenzene sulfonic acids.

The lubricant may comprise 20 to 1000 ppm, 30 to 500 ppm, or 40 to 300 ppm of the amphiphilic amine which is a compound of formula (A1), and 20 to 1000 ppm, 30 to 500 ppm, or 40 to 300 ppm of the amphiphilic acid. Preferably, the lubricant comprises 30 to 500 ppm of the amphiphilic amine which is a compound of formula (A1), and 30 to 500 ppm of the amphiphilic acid. In another preferred form the lubricant comprises 20 to 1000 ppm of the amphiphilic amine which is a compound of formula (A1), and 20 to 1000 ppm of the amphiphilic acid.

The lubricant may comprise 20 to 1000 ppm, 30 to 500 ppm, or 40 to 300 ppm of the amphiphilic amine which is a compound of formula (A1), and 20 to 1000 ppm, 30 to 500 ppm, or 40 to 300 ppm of the amphiphilic acid which is selected from compounds (B1), (B3), (B4), (B5), fatty acids, or alkylbenzene sulfonic acids. Preferably, the lubricant comprises 30 to 500 ppm of the amphiphilic amine which is a compound of formula (A1), and 30 to 500 ppm of the amphiphilic acid which is selected from compounds (B1), (B3), (B4), (B5), fatty acids, or alkylbenzene sulfonic acids. In another preferred form the lubricant comprises 20 to 1000 ppm of the amphiphilic amine which is a compound of formula (A1), and 20 to 1000 ppm of the amphiphilic acid which is selected from compounds (B1), (B3), (B4), (B5), fatty acids, or alkylbenzene sulfonic acids.

The weight ratio of the amphiphilic amine which is the compound (A1) and the amphiphilic acid which is the compound (B1) can be from 10:1 to 1:10, 5:1 to 1:5, or 3:1 to 1:3, or 2.5:1 to 1:2.5. The weight ratio of the amphiphilic amine which is the compound (A1) and the amphiphilic acid which is the compound (B2) can be from 10:1 to 1:10, 5:1 to 1:5, or 3:1 to 1:3, or 2.5:1 to 1:2.5. The weight ratio of the amphiphilic amine which is the compound (A1) and the amphiphilic acid which is the compound (B3) can be from 10:1 to 1:10, 5:1 to 1:5, or 3:1 to 1:3, or 2.5:1 to 1:2.5. The weight ratio of the amphiphilic amine which is the compound (A1) and the amphiphilic acid which is the compound (B4) can be from 10:1 to 1:10, 5:1 to 1:5, or 3:1 to 1:3, or 2.5:1 to 1:2.5. The weight ratio of the amphiphilic amine which is the compound (A1) and the amphiphilic acid which is the compound (B5) can be from 10:1 to 1:10, 5:1 to 1:5, or 3:1 to 1:3, or 2.5:1 to 1:2.5. The weight ratio of the amphiphilic amine which is the compound (A1) and the amphiphilic acid which is the fatty acid can be from 10:1 to 1:10, 5:1 to 1:5, or 3:1 to 1:3, or 2.5:1 to 1:2.5. The weight ratio of the amphiphilic amine which is the compound (A1) and the amphiphilic acid which is the alkylbenzene sulfonic acids can be from 10:1 to 1:10, 5:1 to 1:5, or 3:1 to 1:3, or 2.5:1 to 1:2.5.

The lubricant may comprises at least 10, 40, 60 or 80 ppm of the amphiphilic amine which is the compound (A1). The lubricant may comprises up to 1500, 1000, 800, 500, or 300 ppm of the amphiphilic amine which is the compound (A1). The lubricant may comprise 20 to 1000 ppm, 30 to 500 ppm, or 40 to 300 ppm of the amphiphilic amine which is the compound (A1).

The lubricant may comprises at least 10, 40, 60 or 80 ppm of the amphiphilic acid which is the compound (B1). The lubricant may comprises up to 1500, 1000, 800, 500, or 300 ppm of the amphiphilic acid which is the compound (B1). The lubricant may comprise 20 to 1000 ppm, 30 to 500 ppm, or 40 to 300 ppm of the amphiphilic acid which is the compound (B1).

The lubricant may comprises at least 10, 40, 60 or 80 ppm of the amphiphilic acid which is the compound (B2). The lubricant may comprises up to 1500, 1000, 800, 500, or 300 ppm of the amphiphilic acid which is the compound (B2). The lubricant may comprise 20 to 1000 ppm, 30 to 500 ppm, or 40 to 300 ppm of the amphiphilic acid which is the compound (B2).

The lubricant may comprises at least 10, 40, 60 or 80 ppm of the amphiphilic acid which is the compound (B3). The lubricant may comprises up to 1500, 1000, 800, 500, or 300 ppm of the amphiphilic acid which is the compound (B3). The lubricant may comprise 20 to 1000 ppm, 30 to 500 ppm, or 40 to 300 ppm of the amphiphilic acid which is the compound (B3).

The lubricant may comprises at least 10, 40, 60 or 80 ppm of the amphiphilic acid which is the compound (B4). The lubricant may comprises up to 1500, 1000, 800, 500, or 300 ppm of the amphiphilic acid which is the compound (B4). The lubricant may comprise 20 to 1000 ppm, 30 to 500 ppm, or 40 to 300 ppm of the amphiphilic acid which is the compound (B4).

The lubricant may comprises at least 10, 40, 60 or 80 ppm of the amphiphilic acid which is the compound (B5). The lubricant may comprises up to 1500, 1000, 800, 500, or 300 ppm of the amphiphilic acid which is the compound (B5). The lubricant may comprise 20 to 1000 ppm, 30 to 500 ppm, or 40 to 300 ppm of the amphiphilic acid which is the compound (B5).

The lubricant may comprises at least 10, 40, 60 or 80 ppm of the amphiphilic acid which is the fatty acid. The lubricant may comprises up to 1500, 1000, 800, 500, or 300 ppm of the amphiphilic acid which is the fatty acid. The lubricant may comprise 20 to 1000 ppm, 30 to 500 ppm, or 40 to 300 ppm of the amphiphilic acid which is the fatty acid.

The lubricant may comprises at least 10, 40, 60 or 80 ppm of the amphiphilic acid which is the alkylbenzene sulfonic acids. The lubricant may comprises up to 1500, 1000, 800, 500, or 300 ppm of the amphiphilic acid which is the alkylbenzene sulfonic acids. The lubricant may comprise 20 to 1000 ppm, 30 to 500 ppm, or 40 to 300 ppm of the amphiphilic acid which is the alkylbenzene sulfonic acids.

EXAMPLES

Amine A: Compound of formula (A1)
Acid A: Compound of formula (B1)
Acid B: Compound of formula (B2)
Acid C: Compound of formula (B3)
Acid D: Compound of formula (B4)
Group II Base Oil: Group II type mineral base oil VG 46, commercially available from Chevron®.
Group III Base Oil: Group III type paraffinic base oil, available as Shell® XHVI 8.
Group III+ Base Oil: Group III type base oil, isoparrafines, prepared from gas-to-liquid technology, available as Shell® Risella® X 415.
Group IV Base Oil: Group IV type base oil VG46, polyalphaolefin, mixed from SpectraSyn® 40 and SpectraSyn® 6, both from ExxonMobil.

Example 1

The additives were mixed at room temperature with the mineral oils as listed in Table 1 and 2. Then the electric conductivity was determined with a Model 1152 Digital Conductivity Meter from EMCEE Electronics Inc., USA. The meter consisted of an electronics assembly and a detachable stainless steel probe. The probe was immersed into the fluid up to the set of holes closet to the electronics assembly. Depressing the "M" pushbutton caused a direct current to flow through the fluid between the electrodes. The current was amplified in the electronics assembly and was displayed on the liquid crystal display in picosiemens per meter (pS/m).

TABLE 1

Electric conductivity in pS/m

| Entry | Additive | Group II Base Oil |
|---|---|---|
| A [a)] | No Additives | 0 |
| B [a)] | 100 ppm Amine A | 0 |
| C | 100 ppm Amine A<br>100 ppm Acid B | 33.5 |
| D | 200 ppm Amine A<br>100 ppm Acid B | 36 |
| E | 100 ppm Amine A<br>200 ppm Acid B | 49 |

[a)] Comparative examples

Example 2

A turbine oil was prepared from 0.4 wt % of Additive Package 1, optionally 400 ppm Amine A, and filled up to 100 wt % with the hydrocarbon oils listed in Table 2. The electric conductivity at room temperature was determined as in Example 1.

The Additive Package 1 is a commercially available ashless additive package containing antioxidants, corrosion inhibitors and metal deactivators. It comprises 0.7 wt % of the Acid B and 4.7 wt % of the Acid D. The resulting concentration in the hydrocarbon oil was 28 ppm Acid B and 188 ppm Acid D. The Additive Package 1 was free of amphiphilic amines or and free of other amphiphilic acids.

TABLE 2

| Electric conductivity [pS/m] with Additive Package 1 (contains Acid B and Acid D) | | | |
|---|---|---|---|
| Entry | Hydrocarbon Oil | without Amine A [a)] | 400 ppm Amine A |
| A | Group II Base Oil | 0 | 69 |
| B | Group III Base Oil | 0 | 52 |
| C | Group III+ Base Oil | 0 | 222 |
| D | Group IV Base Oil | 0 | 66 |

[a)] Comparative examples

Example 3

A turbine oil was prepared from 0.4 wt % of Additive Package 2, optionally 200 ppm Amine A, and filled up to 100 wt % with the hydrocarbon oils listed in Table 3. The electric conductivity at room temperature was determined as in Example 1.

The Additive Package 2 is a commercially available ashless additive package containing antioxidants, corrosion inhibitors and metal deactivators. It comprises 0.7 wt % of the Acid B and 4.7 wt % of the Acid D. The resulting concentration in the hydrocarbon oil was 28 ppm Acid B and 188 ppm Acid C. The Additive Package 2 was free of amphiphilic amines or and free of other amphiphilic acids.

TABLE 3

| Electric conductivity [pS/m] with Additive Package 2 (including Acid B and Acid C) | | | |
|---|---|---|---|
| Entry | Hydrocarbon Oil | without Amine A [a)] | 200 ppm Amine A |
| A | Group II Base Oil | 0 | 106 |
| B | Group III Base Oil | 0 | 45 |
| C | Group III+ Base Oil | 0 | 186 |
| D | Group IV Base Oil | 0 | 48 |

[a)] Comparative examples

Example 4

A turbine oil was prepared from 0.4 wt % of Additive Package 1, optionally Amine A and Acid A or B, and filled up to 100 wt % with Group III+ Base Oil. The electric conductivity at room temperature was determined as in Example 1 and summarized in Table 4.

The addition of the Additive Package 1 resulted in a concentration in the hydrocarbon oil of 28 ppm Acid B and 188 ppm Acid D.

TABLE 4

| Electric conductivity [pS/m] with Additive Package 1 (contains Acid B and Acid D) | | |
|---|---|---|
| Entry | Amounts | Electric conductivity [pS/m] |
| A [a)] | — | 0 |
| B | 200 ppm Amine A<br>200 ppm Acid A | 80 |
| C | 200 ppm Amine A<br>200 ppm Acid B | 121 |

[a)] Comparative example

Example 5

A turbine oil was prepared from 0.4 wt % of Additive Package 1, optionally Amine A and Acid A or B, and filled up to 100 wt % with Group III+ Base Oil. The electric conductivity at room temperature was determined as in Example 1 and summarized in Table 5.

The addition of the Additive Package 1 resulted in a concentration in the hydrocarbon oil of 28 ppm Acid B and 188 ppm Acid D.

TABLE 5

| Electric conductivity [pS/m] with Additive Package 1 (contains Acid B and Acid D) | | |
|---|---|---|
| Entry | Amounts | Electric conductivity [pS/m] |
| A [a)] | 0 | 0 |
| B | 50 ppm Amine A<br>50 ppm Acid A | 72 |
| C | 50 ppm Amine A<br>50 ppm Acid B | 81 |

[a)] Comparative example

Example 6

A turbine oil was prepared from 1.2 wt % of Additive Package 3, optionally Amine A and Acid A or B, and filled up to 100 wt % with Group III+ Base Oil. The electric conductivity at room temperature was determined as in Example 1 and summarized in Table 6.

The Additive Package 3 is a commercially available additive package containing antioxidants, corrosion inhibitors and metal deactivators. It comprises 1.77 wt % of the Acid A. The resulting concentration in the hydrocarbon oil was 106 ppm Acid A (not yet including the amount of the separately added Acid A). The Additive Package 3 was free of amphiphilic amines or and free of other amphiphilic acids.

TABLE 6

| Electric conductivity [pS/m] with Additive Package 3 (including Acid A) | | |
|---|---|---|
| Entry | Amounts | Electric conductivity [pS/m] |
| A [a)] | 0 | 0 |
| B | 200 ppm Amine A<br>200 ppm Acid A | 43 |
| C | 200 ppm Amine A<br>200 ppm Acid B | 54 |

[a)] Comparative example

The invention claimed is:

1. A method for increasing the electric conductivity of a lubricant based on a hydrocarbon oil comprising the step of contacting the hydrocarbon oil with a blend comprising A) an amphiphilic amine, comprising an imidazoline group and a $C_{6-32}$ hydrocarbon group, and B) an amphiphilic acid selected from compounds (B1) or (B3), (B1)

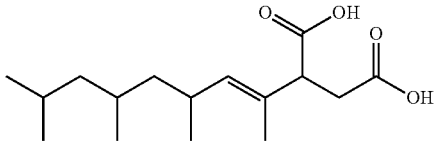

(B3)

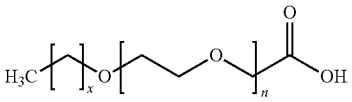

where x is from 11 to 13 and n from 2 to 15, and wherein the lubricant comprises 20 to 1000 ppm of the amphiphilic amine, and 20 to 1000 ppm of the amphiphilic acid.

2. The method according to claim 1 where the weight ratio of the amphiphilic amine and the amphiphilic acid is from 5:1 to 1:5.

3. The method according to claim 1 where the amphiphilic amine is a compound of formula (A1)

(A1)

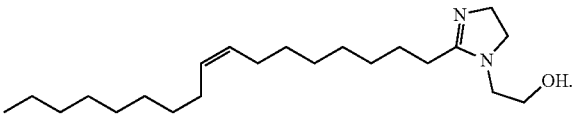

4. The method according to claim 1 where lubricant comprises at least 50 wt % of the hydrocarbon oil.

5. The method according to claim 1 where electric conductivity of the hydrocarbon oil is below 30 pS/m.

6. The method according to claim 1 where electric conductivity of the lubricant is increased to at least 30 pS/m.

7. The method according to claim 1 where the lubricant is a turbine oil or a hydraulic oil.

8. A lubricant based on a hydrocarbon oil comprising a blend comprising

A) an amphiphilic amine which is a compound of formula (A1)

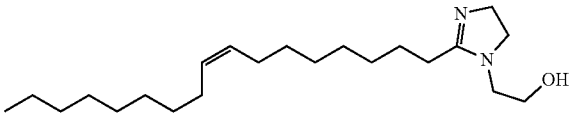

and

B) an amphiphilic acid which is selected from compounds (B1) or (B3), (B1)

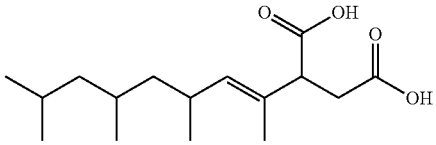

(B3)

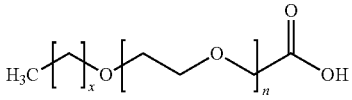

where x is from 11 to 13 and n from 2 to 15, wherein the lubricant comprises 20 to 1000 ppm of the amphiphilic amine, and 20 to 1000 ppm of the amphiphilic acid.

9. The lubricant according to claim 8 where the weight ratio of the amphiphilic amine and the amphiphilic acid is from 5:1 to 1:5.

10. The method according to claim 1 where lubricant comprises at least 80 wt % of the hydrocarbon oil.

11. The method according to claim 1 where lubricant comprises at least 90 wt % of the hydrocarbon oil.

* * * * *